United States Patent [19]

Clausing et al.

[11] 4,245,204

[45] Jan. 13, 1981

[54] CIRCUIT BREAKER MAGNETIC TRIP DEVICE

[75] Inventors: Challiss I. Clausing, Marlton, N.J.; Einar H. Fredrickson, Ambler, Pa.

[73] Assignee: Gould Inc., Rolling Meadows, Ill.

[21] Appl. No.: 921,827

[22] Filed: Jul. 3, 1978

[51] Int. Cl.[3] ..... H01H 9/00; H01F 7/00

[52] U.S. Cl. ..... 335/174; 335/229

[58] Field of Search ..... 335/38, 172, 174, 229, 335/230

[56] References Cited

U.S. PATENT DOCUMENTS

| | | | |
|---|---|---|---|
| 2,663,775 | 12/1953 | MacNeill et al. | 335/174 X |
| 2,669,623 | 2/1954 | MacNeill et al. | 335/174 X |
| 2,840,663 | 6/1958 | Horn | 335/174 X |
| 3,699,486 | 10/1972 | DeLucia | 335/229 X |
| 4,072,918 | 2/1978 | Read | 335/174 X |

*Primary Examiner*—Fred L. Braun

*Attorney, Agent, or Firm*—Ostrolenk Faber Gerb & Soffen

[57] ABSTRACT

A magnetic trip unit for a circuit breaker having an armature and a plunger; the armature completes a magnetic path through the poles of a permanent magnet; the armature and plunger are biased toward trip position but are held by the permanent magnet and may be restored to the position where the armature completes the path through the poles of the permanent magnet. A trip coil is provided surrounding the permanent magnet and armature. A casing of magnetic material surrounds the trip coil and extends below the armature; this casing also has top and bottom walls of magnetic material and an inner cup shaped sleeve bearing against the bottom wall and against one pole of the permanent magnet. Energization of the trip coil establishes an additional magnetic path through the armature and the one pole of the permanent magnet which opposes the magnetic force of the first mentioned magnetic path and permits the bias on the armature and plunger to move them to trip position.

2 Claims, 13 Drawing Figures

CONTACTS OPEN
SPRINGS CHARGED

CONTACTS CLOSED
SPRINGS DISCHARGED

CONTACTS OPEN - TRIPPED-
SPRINGS DISCHARGED

FIG. 4.
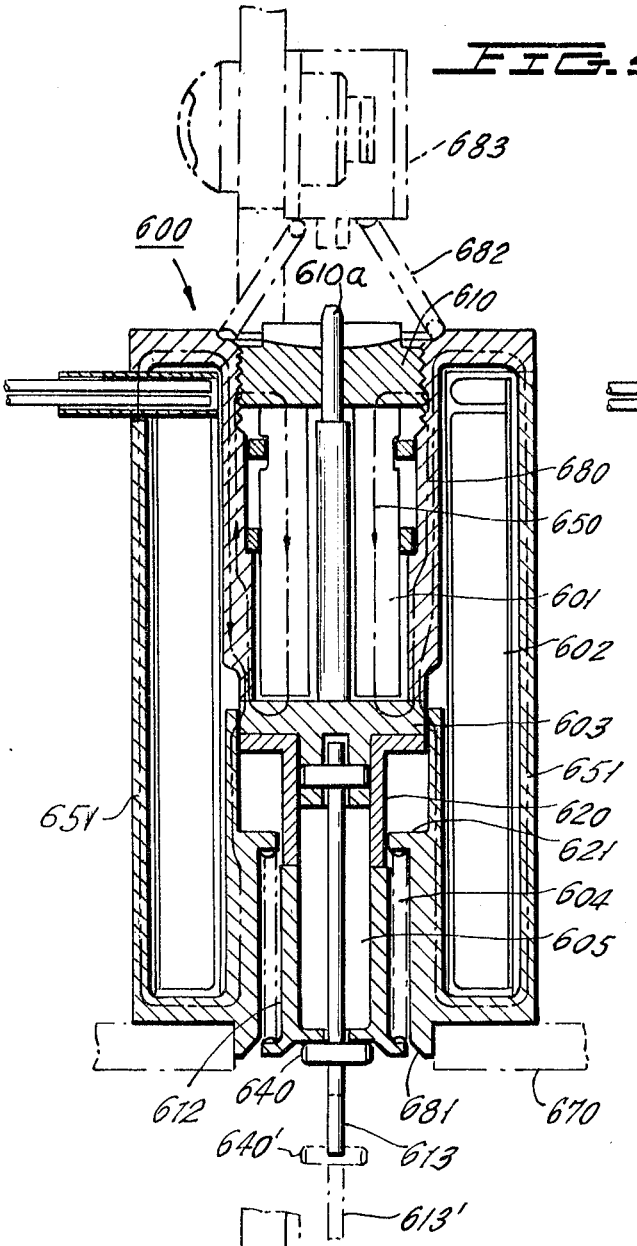
FIG. 5.
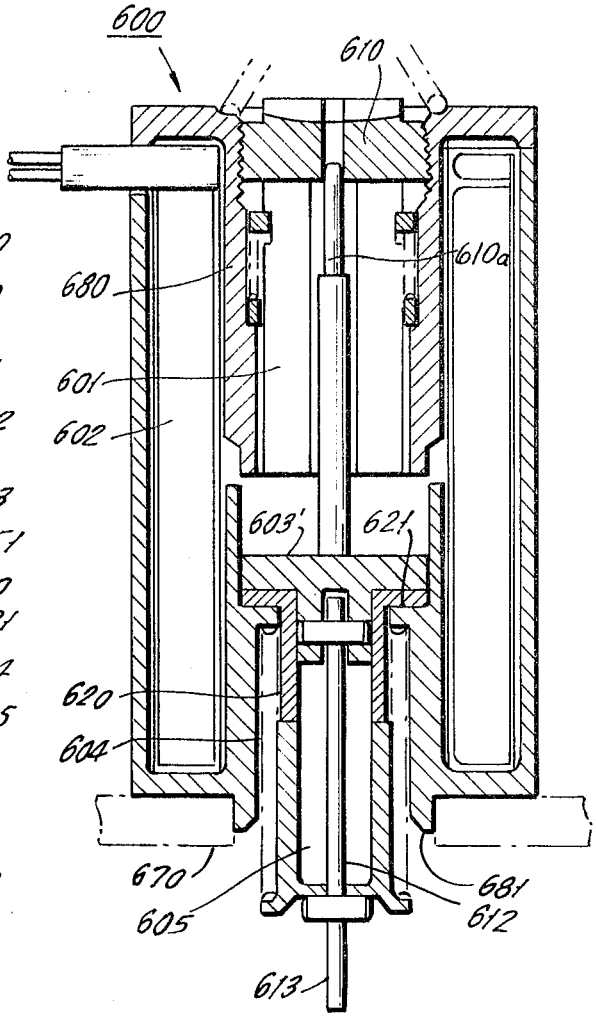
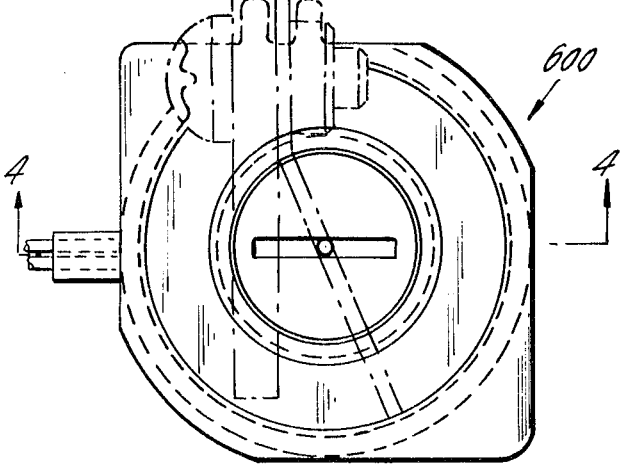
FIG. 6.

CIRCUIT BREAKER MAGNETIC TRIP DEVICE

The present invention relates to circuit breakers and particularly to a trip unit for a circuit breaker in which a magnetic latch functions on a signal received, preferably from a solid state device, to effect the tripping operation.

As is well known in the construction and operation of circuit breakers the principal contacts when they are engaged are supported by a latch member or prop latch which supports a toggle or other mechanism which, but for the prop latch, would collapse in response to the opening bias on the circuit breaker contacts.

The purpose of the magnetic trip device is to momentarily move the prop latch out of position so that the toggle or other support element will collapse under the opening bias applied to the principal contacts and thereby permit the principal contacts to open. In the instant structure the signal for operation will be received from a solid state device. The magnetic trip unit must provide several pounds of trip force in order to be able to move the prop latch to the non-supporting position. It must be insensitive to mechanical shock and it must release on low level ground fault signals. For economy in selecting solid state trip components, the magnetic latch must have a release sensitivity on the order of 0.1 volt amperes.

The tripping device functions from a permanent magnet which is closely coupled to its return circuit through a movable armature. The trip coil in the magnetic field trip unit of the present invention is situated so that, when energized, it decreases the flux in the armature air gap. This is accomplished with a minimum number of ampere turns as compared to previous flux shifting types of magnets.

One of the major objects of the present invention is to arrange the magnetic trip device so that it will allow the components in the energizing unit for the magnetic trip device to have reduced ratings. Thus in cases where a solid state operation is desired the source of energy for the tripping may be much lower in size, output and cost. Thus, while the sensitivity in volt amperes of trip units of the same general type may be somewhat the same, the actual current drain of the trip unit of the present invention is much less than that which has been experienced in any other device.

This is a result of the construction of the unit. The further construction of the unit as a cylinder provides both structural strength, magnetic shielding and a magnetic return path in a single part. Likewise the armature and critical parts are protected from dirt and magnetic particles because of the structure of the unit.

The invention is related to circuit breaker devices of the type shown in U.S. Pat. Nos. 4,101,744, issued July 18, 1978; 4,146,764, issued Mar. 27, 1979; and 4,146,765, issued Mar. 27, 1979.

The foregoing and many other objects of the present invention will become apparent from the following description and drawings in which:

FIG. 1 is a side view partly in cross-section of the principal operating mechanism of the circuit breaker of the type previously referred to.

FIG. 1*a* is a top view of a portion of the structure of FIG. 1 taken from line 1*a*—1*a* of FIG. 1 looking in the direction of the arrows.

FIG. 4 is a cross-sectional view of the magnetic trip device of the present invention which appears particularly in FIG. 3 showing the trip coil de-energized and the armature held in the non-trip position.

FIG. 5 is a view corresponding to that of FIG. 4 showing the trip coil energized to change the magnetic path and decrease the flux through part of the armature thereby permitting the armature spring to drive the armature toward the trip position.

FIG. 6 is a view taken from the top of the structure of FIGS. 4 and 5 showing the arrangement of the elements thereof.

Figures 1, 1A:
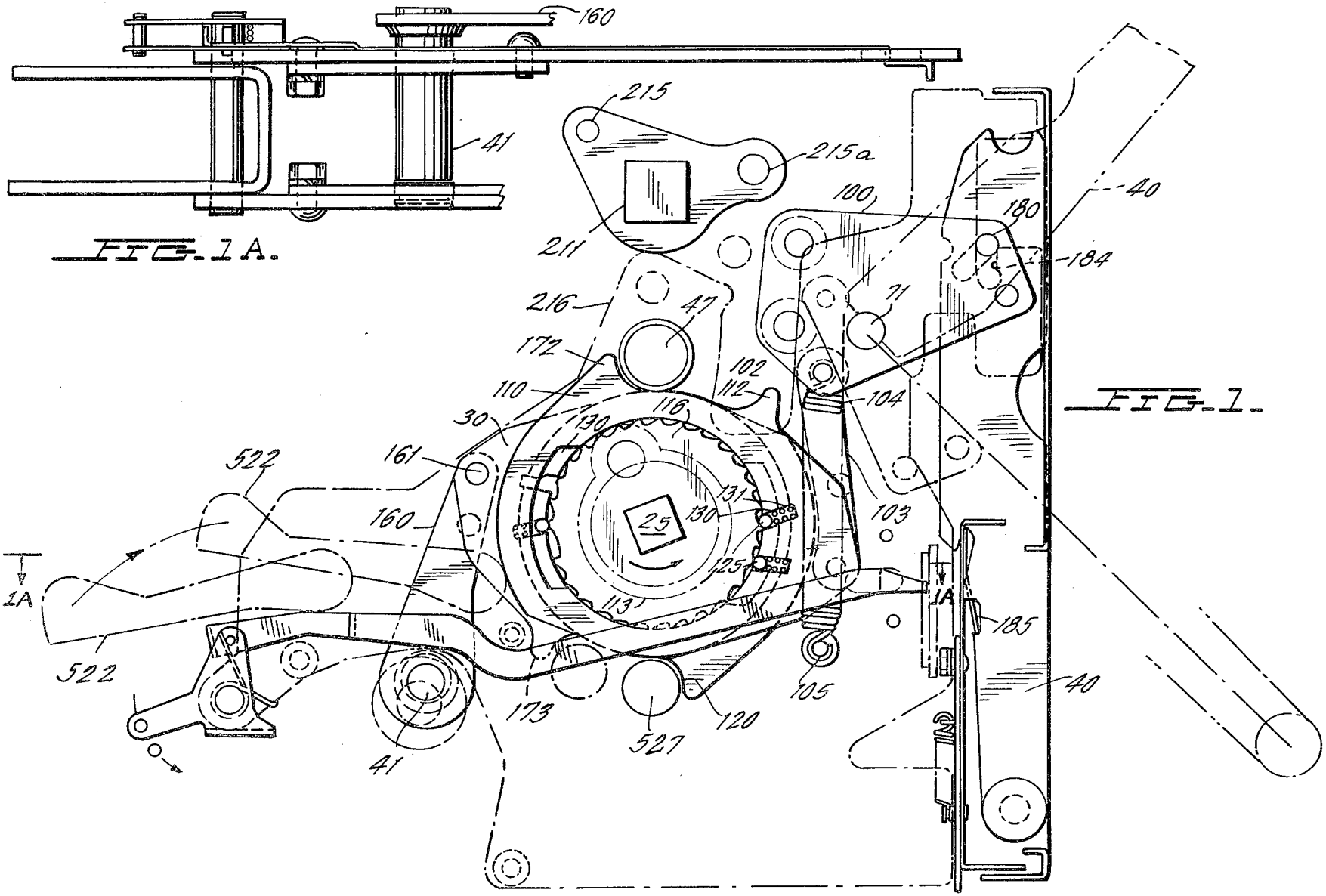

Referring now to the drawings, it is desirable first to describe the operation of the circuit breaker mechanism in order that the shunt trip magnetic structure may be fully understood.

Referring first to FIGS. 1, 2, 3 and 3A there is shown the mechanism for charging the closing springs and preparing the circuit breaker for operation. When the closing springs have discharged to close the circuit breaker, the prop latch 73 supports the main contacts, as hereinafter described, against the opening bias on the main contacts. The magnetic trip unit 600 of the present invention will, when operated, rotate the prop latch out of the support position and permit the contacts to open. The elements of the circuit breaker which center about the prop latch 73 must therefore first be understood.

The principal operating shaft 25 carries the first operating cam 26. It also carries pawl carrier 30 which pawl carrier has within it a plurality of ratchet mechanisms indicated schematically in the side cross-sectional view of FIG. 1.

Essentially the operation counterclockwise of the pawl carrier 30 (which includes the pawl mechanisms of FIG. 1) will result in rotation of the shaft 25 and the charging of the closing springs preparatory to operation of the circuit breaker.

Figure 3:
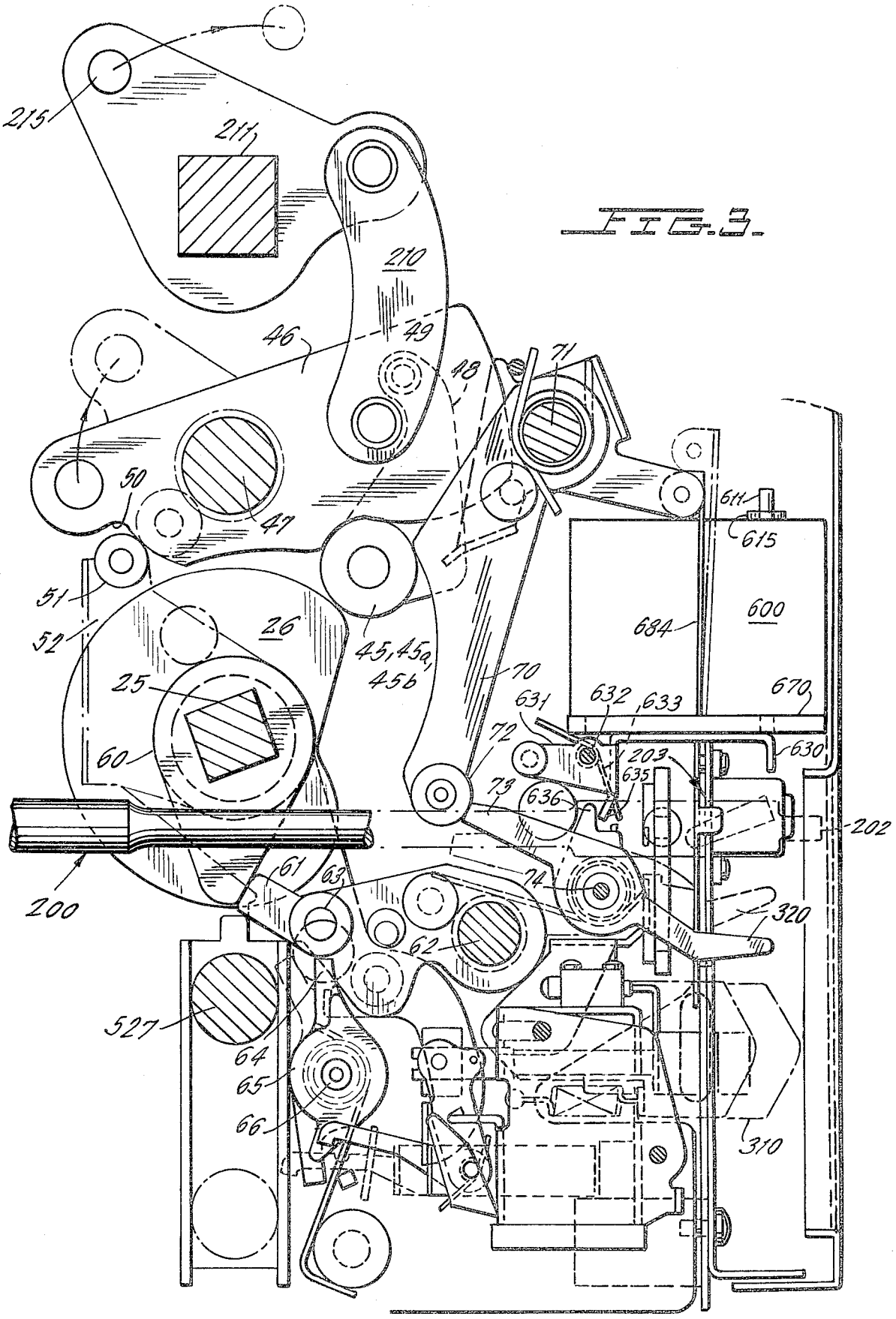
FIG. 3 is a view corresponding to that of FIG. 2 but showing additional details and a different position of the mechanism of FIG. 2. The magnetic shunt trip of the present invention is particularly apparent in the FIG. 3 view.
Figure 3A:
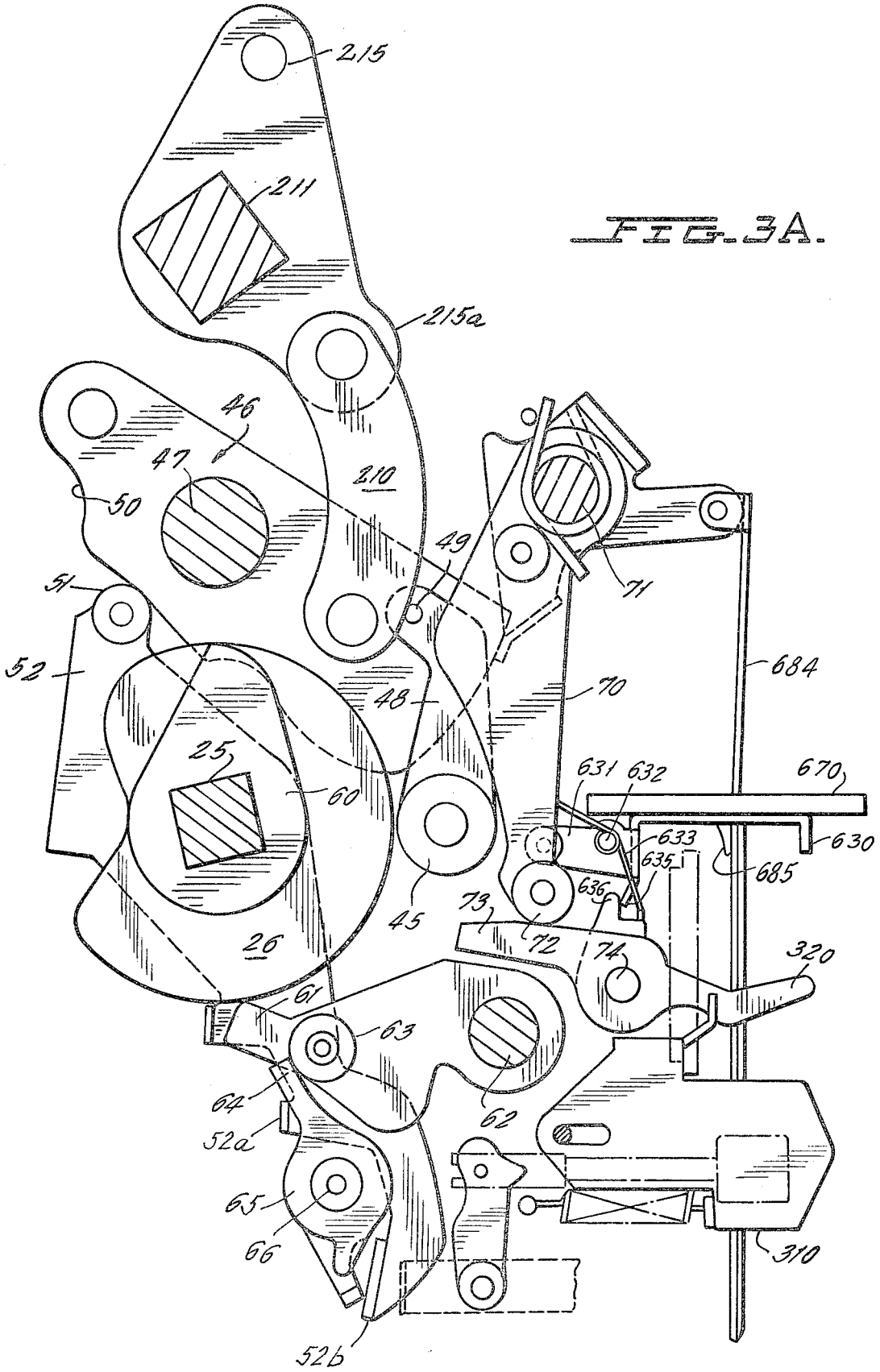
FIG. 3A is a schematic view including those elements of FIG. 3 which are essential to a full understanding of the structure showing the position of the elements with the contacts open, the trip latch in the tripped position.
Figures 3B, 3C, 3D:
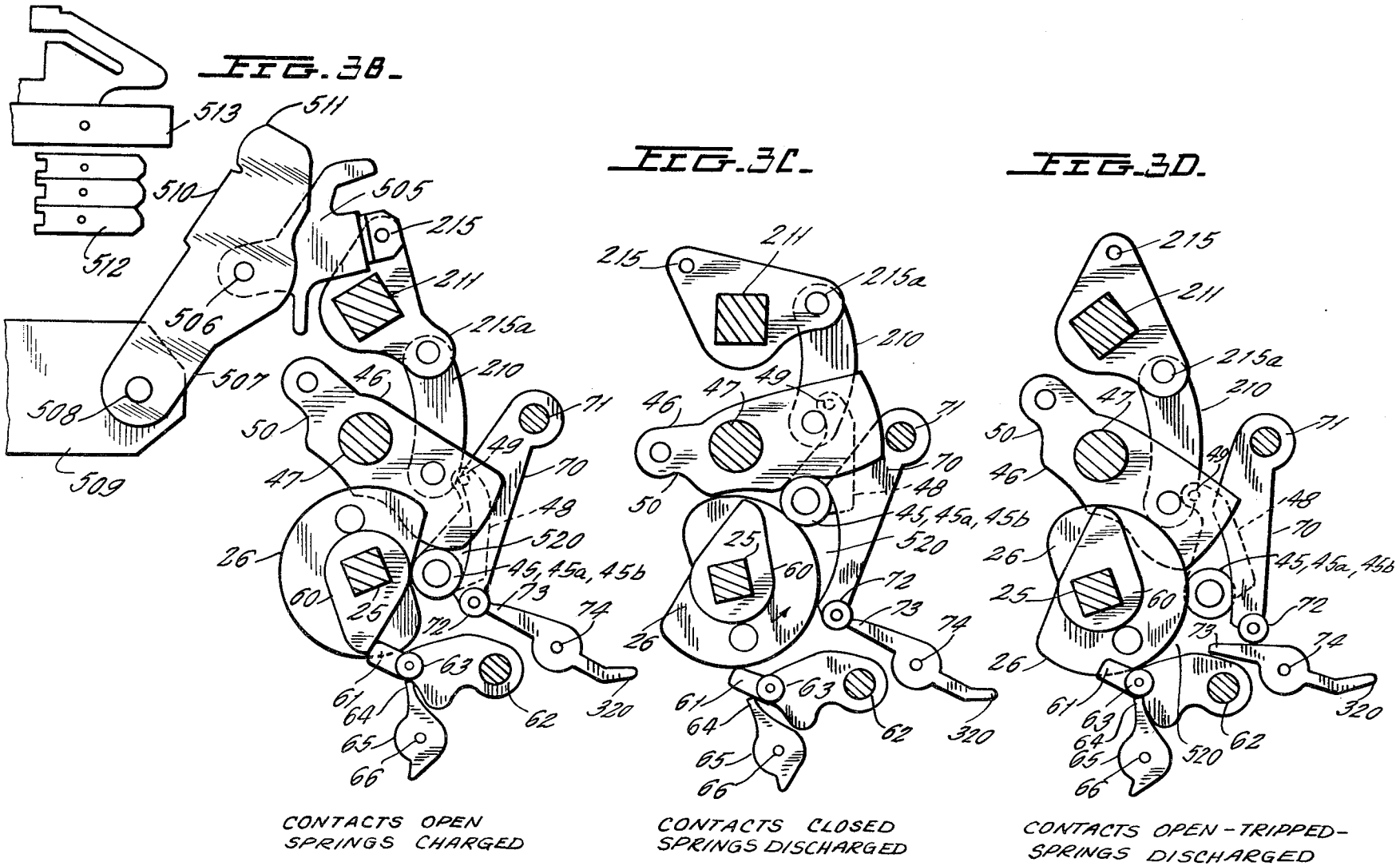
FIG. 3B is a view corresponding to that of FIG. 3A showing the position of the elements with the contacts open and the springs charged.
FIG. 3C is a view corresponding to FIGS. 3A and 3B showing the position of the elements with the contacts closed and the springs discharged.
FIG. 3D is a view corresponding to FIGS. 3A, 3B and 3C showing the position of the elements with the contacts open, springs discharged and the circuit breaker in tripped position.
Figure 7:
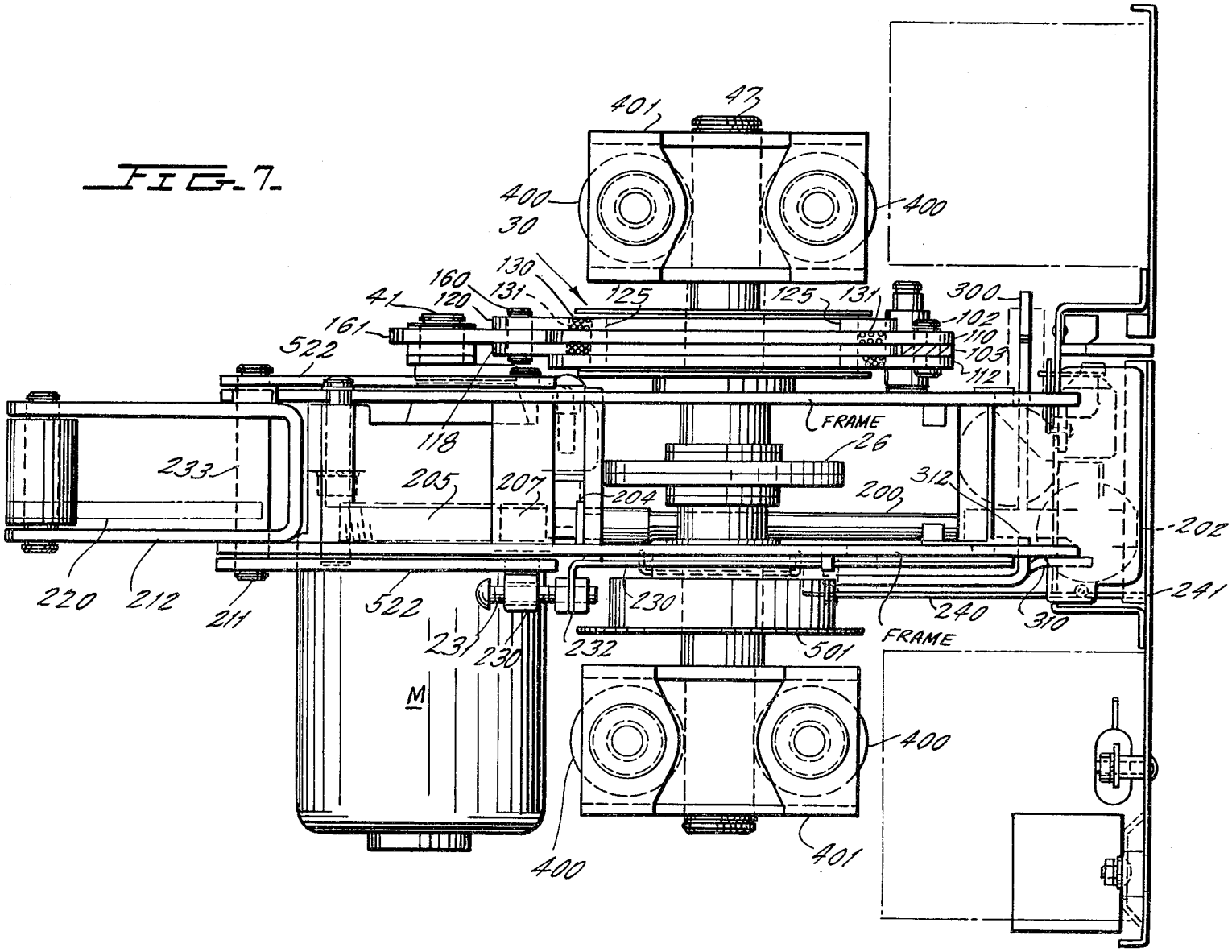
FIG. 7 is a top view of the mechanism of FIGS. 1 and 2.

This operation results in moving the elements of FIG. 3A to the "CONTACTS OPEN, SPRING CHARGED" position of FIG. 3B. The pawl carrier 30 containing the drive pawl may be operated either by the manual handle 40 or by the motor crank 41 in the manner hereinafter described.

In the structure shown in the Figures above referred to, the shaft 25 is to be driven counterclockwise in the direction indicated by the arrow in FIG. 1 in order to charge the springs. For this purpose the handle 40 is so connected as to be operated in a clockwise direction to perform the operation while the crank arm 41 can be operated in either direction to perform this operation. On closing of the circuit breaker the lower end of lever 52*a* forcibly resets the closing secondary latch 64 and primary closing latch 61 and this in turn resets primary closing latch 61. Lever end 52*b* disconnects the electrical and mechanical closing means. The breaker cannot accidentally be opened by operation of the closing springs upon recharge. The closing springs can be discharged only when the breaker is open.

The latch member 60 carried by the shaft 25 is driven against its latch 61 which is pivotally mounted on the stationary pivot 62 and is provided with a latch roller 63 which is supported by the closing latch 64. The closing latch 64 is an extension of the bell crank lever 65 which is pivoted on the stationary pivot 66.

The shaft 25 may be rotated in a counterclockwise direction to charge the springs as previously pointed out by the handle 40 and by the motor crank arm 41. The handle 40 is inserted into the bell crank lever 100 which has a fixed pivot pin 71.

Figure 8:
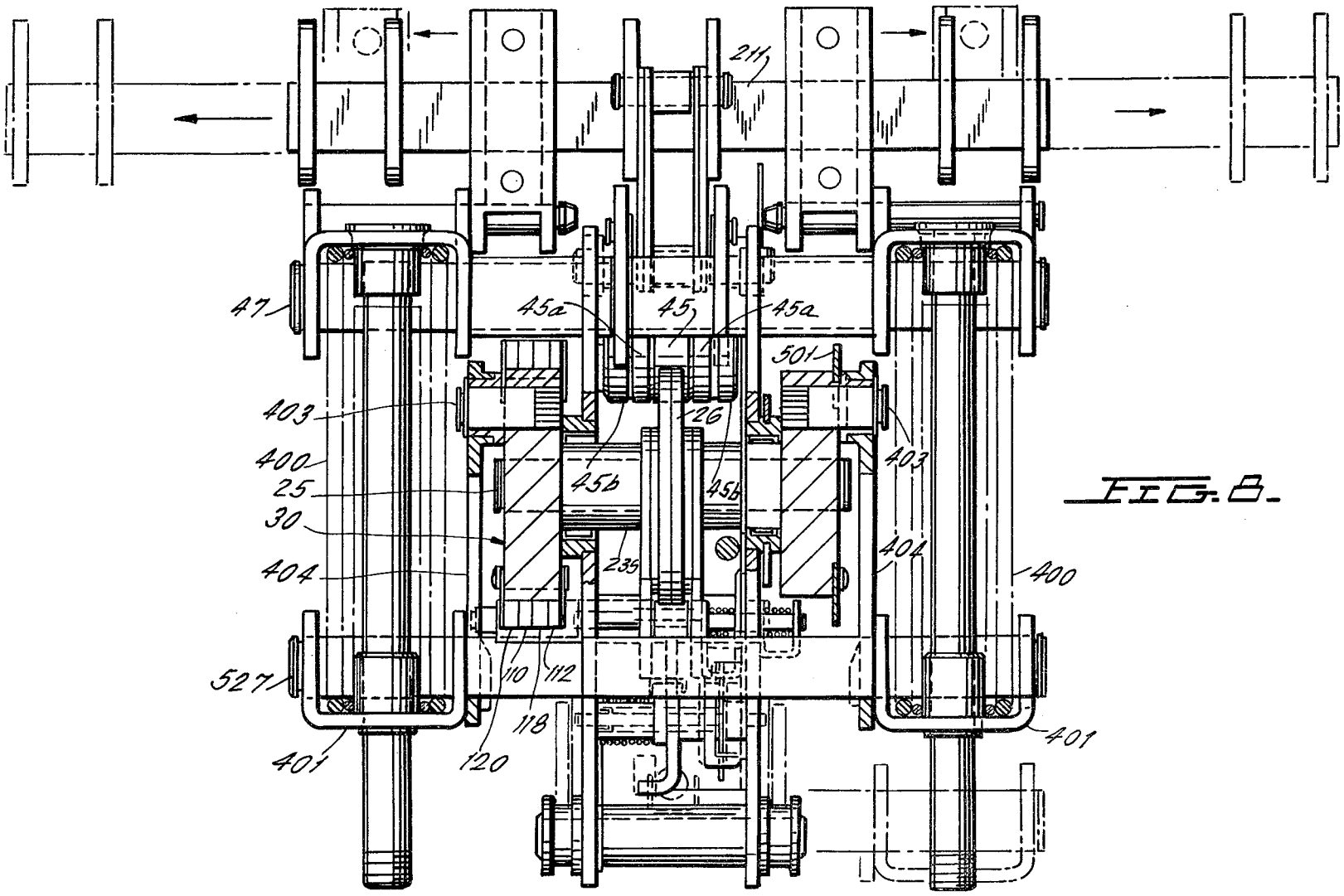
FIG. 8 is a rear view of the circuit breaker operating mechanism showing an alternate arrangement of the closing springs.

The pawl carriers (see FIGS. 1 and 8) 110 and 112 (FIG. 8) cooperate with the stop 47 (FIG. 1) and the pawl carriers 118 and 120 are positioned by the motor crank 41 so that when the tail 172 on the pawl carriers 110 and 112 engages the stop 47 the rotation of the shaft 25 in a clockwise direction is halted.

Upon discharge of the closing springs (see FIG. 2 and FIG. 3C), the shaft 25 is rotated and the first cam 26 operates through the roller 45 and rollers 45*a*, 45*b* to rotate the third closing cam 46 in a counterclockwise direction around its pivot 47. The rollers 45, 45*a* and 45*b* are supported on the arm 48 which is supported on the pivot 49 which is a part of cam 46. The end of the third closing cam 46 opposite to that which is engaged by the roller 45*b* is provided with a recess 50 which engages the roller 51 on the lever 52 which is pivoted on the shaft 25.

The second closing cam 70 is stationarily pivoted on the pivot 71 and is provided with the latch roller 72 which bears against the trip latch 73 which is the latch which must be operated to trip the circuit breaker. The trip latch 73 is rotatably mounted on the pivot 74 and spring biased toward the position shown in FIG. 2. Thus as the springs are charged shaft 25 is rotated counterclockwise until member 60 is blocked by the prop latch 61 for the closing device; the prop latch 61 is in turn supported by the engagement of latch roller 63 with the closing latch 64. This occurs when the closing springs are fully charged (see FIG. 3B).

The link 210 is connected to extension 215*a* of contact jack shaft 211. The opposite extension 215 on contact jack shaft 211 is connected to push rod 505 (see FIG. 3B) which in turn is connected by pin 506 to moving arm 507. Contact arm 507 is pivotally mounted at 508 on the extension 509 of the lower back connection stud and is provided with the moving main contact 510 and arcing contact 511 which in turn are operated, on rotation of contact arm 507 in a counterclockwise direction, to engage stationary main contact 512 (FIG. 3B) and stationary arcing contact 513.

When a three pole circuit breaker is used, the operating mechanism is connected to the center pole. As described in the applications above mentioned, extensions of the two outside poles are connected to opening tension springs which, at their opposite ends, are connected to a stationary point on the frame to provide the necessary opening bias for the contact arm 507 when the trip latch is operated.

FIGS. 3B, 3C and 3D show, respectively, the position of the parts for—contacts open, springs charged—contacts closed, springs discharged—contacts open, tripped or trip free, springs discharged.

Figure 2:
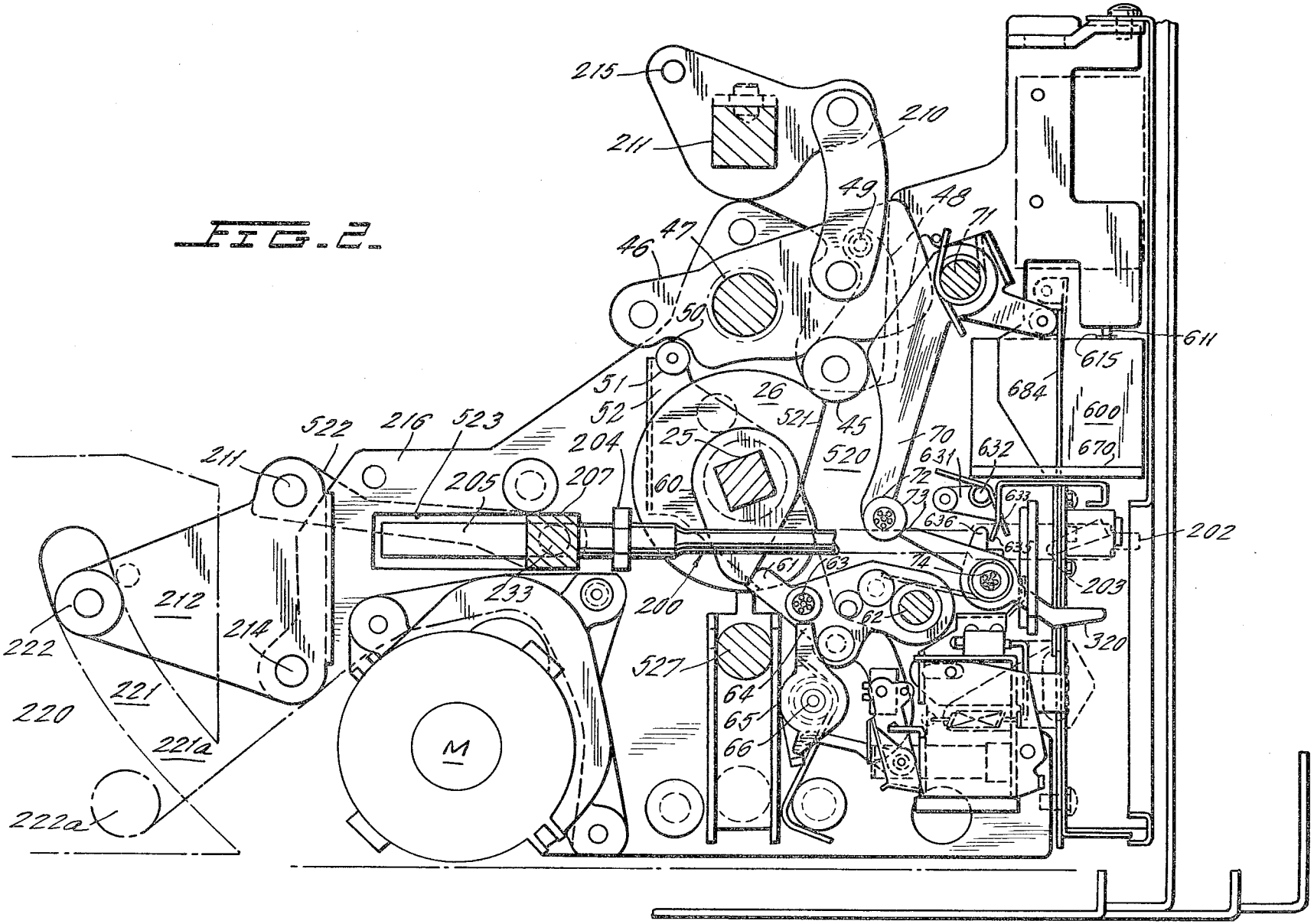
FIG. 2 is a cross-sectional view showing the side of the mechanism from front to back showing the position of the elements with the contacts closed and the closing springs charged.

In FIG. 2 it is seen that a cam slot 520 of variable curvature is, in effect, formed between the second closing cam 70 and the side 521 of cam 26. As the spring is charged with the contacts open (FIG. 3B) the roller 45 can move to the bottom of cam slot 520. When the contacts are closed and the spring is discharged the roller 45 is at the top of cam slot 520 (FIG. 3C). When the circuit breaker is tripped (FIG. 3D) the second closing cam 70 moves off its support latch 73 (which has been rotated out of supporting position) and the cam slot 520 is widened so that roller 45 is free of any support while, nevertheless, the springs are discharged.

The magnetic trip latch unit 600 is shown in outline in FIG. 3 where it is mounted on the appropriate support hereinafter more fully described. The magnetic trip latch unit is described in detail in connection with FIGS. 4, 5 and 6. A permanent magnet 601 is secured at the upper portion of the magnetic trip latch unit 600. Permanent magnet 601 is surrounded by a trip coil 602 which, in the FIG. 4 position is not energized. The armature 603 which, of course, is of magnetic material is normally held by the permanent magnet 601. The armature 603 is biased downwardly by the compression spring 604 captured in the recess 605 of magnetic latch housing. In this case the magnet is shown as circular and the poles are similarly circular.

The armature 603 completes the magnetic path at the bottom while the plate 610 and the interior section 680 of the housing serves to complete the magnetic path at the top. This complete magnetic path now permits the armature 603 to bridge the gap between the permanent magnet 601 and the interior housing 680 and to remain in position against the bias of the spring 604 which tends to drive it downwardly.

The armature 603 is connected to the plunger 612 which extends downwardly and out of the bottom of the magnetic trip unit 600. The plunger 612 is provided with a non-magnetic spacer 620 which passes through the opening 621 in the bottom of the magnetic unit 600 and thus moves downwardly with the armature 603 and the plunger 612.

As will be seen from the dotted line elements 613′ and 640′ in FIG. 4, when the magnetic force retaining the armature 603 in position is reduced as hereinafter described, the compression spring 604 drives the armature 603 and retaining pin 640 down to the dotted line position 613′ and 640′ driving the plunger 612 and the spacer 620 down to the position shown in FIG. 5, thereby permitting a tripping operation to occur.

This tripping operation is effected when pin 640 of the plunger 612 is moved down to the dotted line position 640′ and strikes the plate (refer once more to FIG. 3) 630 which is carried by an extension 631 on the pivot 632 and biased in a counterclockwise direction by the spring 633. When the plate 630 is rotated clockwise by the plunger of the magnetic unit 600 an extension 635 of the plate 630 strikes the projection 636 of the trip latch 73 rotating the trip latch 73 in a counterclockwise direction and thus removing it as a prop from the roller 72 thereby permitting the collapse of the toggle and support members for the contact shaft 211 thereby permitting a tripping of the circuit breaker to occur.

As previously pointed out the trip coil 602 surrounds the entire magnetic structure. When the trip coil 602 is not energized the magnetic path is shown by the arrowed line 650 of FIG. 4 passing through the magnet 601 and the armature 603. When the trip coil 602 is energized, then an additional magnetic path is set up as shown by the arrowed line 651 of FIG. 4, not only through the interior of the housing 680 in parallel with the permanent magnet 601, but also through the casing 600 of magnetic material of the trip unit. While the legs 650 and 651 of the magnetic path aid the permanent magnet, the leg 680 of the magnetic path opposes the force of the permanent magnet sufficiently to weaken the original holding force on the armature 603. This weakening of the holding force on the armature 603 permits the compression spring 604 to drive the armature 603 down from the solid line position shown in FIG. 4 to the dotted line position of elements 613' and 640' shown in FIG. 4 and also shown in FIG. 5.

The circuit breaker structure as seen in FIG. 3 is provided with a supporting plate 670 for the magnetic trip unit 600. A projection 681 of trip unit 600 engages a round hole in a support plate 670 to position the unit. The unit 600 is held down by a compression spring 682 which in turn is supported by a projection 683 from the mechanism housing. The plate 630 is also provided with appropriate openings through which the plunger end 613 may project.

Plate 610 is threaded into interior housing 680 to position permanent magnet 601 with respect to armature 603 as an adjusting feature. The armature is centered with respect to plate 610 by extension **610*a* passing through plate 610**.

It will now be seen that on an appropriate signal from a tripping circuit, the trip coil 602 is energized. The energization of the trip coil 602 provides an additional magnetic path 651 which, while it in part aids the magnetic path 650 which holds the armature in position, in greater part, opposes this magnetic path to an extent which permits the compression spring 604 to drive the armature 603 down from the solid line position shown in FIG. 4 to the dotted line position shown in FIG. 4. The plate 630 is then rotated so that the tail piece 635 thereof will strike the extension 636 of the prop latch 73 and rotate latch 73 causing the circuit breaker to open.

A resetting device 684 (FIG. 3A) may be provided appropriately located in the circuit breaker mechanism and manually or otherwise operated to engage its extension 685 against plate 630 to drive the plate 630 and hence the plunger 613 to a position where the armature 603 is held against the permanent magnet 601, thereby preparing the circuit breaker for reclosing. This may be operated in any suitable manner, and actually may be operated in parallel with the indicator operator described in the aforementioned applications.

By this means, therefore, a simplified magnetic trip latch is provided in which a signal may be received from any appropriate means which is responsive to a condition which would indicate the desirability or necessity of the circuit breaker to be tripped open. This signal causes energization of the trip coil 602 in a manner to create a magnetic path which will diminish the magnetic force of the permanent magnet holding the armature to the extent that the armature will be permitted to be driven toward the trip position by the compression spring above described. The downward movement of the armature and its plunger rotates prop latch 73 to a non-supporting position thereby permitting the entire toggle arrangement which supports the contact structure in closed contact position to be opened by the opening force or bias imposed upon the contact structure.

In the foregoing, the present invention has been described solely in connection with a preferred illustrative embodiment thereof. Since many variations and modifications of the present invention will now be obvious to those skilled in the art it is preferred that the scope of the invention be defined, not by the specific disclosure herein contained, but only by the appended claims.

What is claimed is:

1. A magnetic trip unit for a circuit breaker, said circuit breaker having a movable contact arm, a movable contact thereon and a complementary contact; biasing means operable on said movable contact arm tending to drive said movable contact arm to open circuit position; means for closing said circuit breaker and means for maintaining said circuit breaker in closed position; said last mentioned means including a rotatable prop latch which may be rotated to a position in which the circuit breaker is tripped and the circuit breaker is no longer maintained in closed position;

a magnetic trip unit comprising a permanent magnet having a pair of poles; an armature of magnetic material held by said permanent magnet and completing a first magnetic path through said permanent magnet;

means biasing said armature away from the poles of said permanent magnet;

an operating plunger carried by said armature and extending in one direction engageable with a portion of said prop latch when the armature is moved by said biasing means to rotate said prop latch to a tripped position;

said operating plunger also carrying a guide member extending axially thereof in a direction opposite to the part of the plunger engageable with said prop latch;

means for moving said armature against said armature biasing means to a position where said armature is held by said permanent region;

and a trip coil surrounding said permanent magnet; said trip coil, when energized, establishing an additional magnetic path through said armature and diminishing the force of the magnetic path through said permanent magnet and armature to an extent which permits the biasing means on said armature to drive said armature and plunger away from the poles of said permanent magnet to trip said circuit breaker open;

a casing of magnetic material surrounding said trip coil;

said casing also having a bottom wall and a top wall of magnetic material;

said additional magnetic path passing through said armature and one of the poles of said permanent magnet, through said casing and the bottom and top walls thereof;

one portion of said additional magnetic path through said one pole of said permanent magnet being in a direction of opposite polarity to the first mentioned magnetic path;

said casing having a bottom wall extending around said trip coil into the interior of said casing and extending adjacent said permanent magnet to complete said additional magnetic path;

wherein a portion of the bottom wall extending into the interior of said casing has an inward projection;

said biasing means for said armature comprising a compression spring bearing between said inward projection and a portion of said plunger.

2. The magnetic trip unit of claim 1 wherein said permanent magnet is circular in cross-section.

* * * * *